US008113765B2

(12) United States Patent
Sullivan

(10) Patent No.: US 8,113,765 B2
(45) Date of Patent: Feb. 14, 2012

(54) WATER LUBRICATED LINE SHAFT BEARING AND LUBRICATION SYSTEM FOR A GEOTHERMAL PUMP

(75) Inventor: Robert M. Sullivan, Reno, NV (US)

(73) Assignee: ORMAT Technologies Inc., Reno, NV (US)

( * ) Notice: Subject to any disclaimer, the term of this patent is extended or adjusted under 35 U.S.C. 154(b) by 948 days.

(21) Appl. No.: 11/965,326

(22) Filed: Dec. 27, 2007

(65) Prior Publication Data

US 2009/0169358 A1 Jul. 2, 2009

(51) Int. Cl.
*F01D 25/18* (2006.01)

(52) U.S. Cl. ..... 415/110; 415/111; 415/112; 416/174; 416/244 R

(58) Field of Classification Search ..... 415/110, 415/111, 112; 416/174, 244 R
See application file for complete search history.

(56) References Cited

U.S. PATENT DOCUMENTS

| | | | | |
|---|---|---|---|---|
| 3,288,073 | A * | 11/1966 | Pezzillo | 417/357 |
| 4,013,384 | A * | 3/1977 | Oikawa | 417/368 |
| 4,135,852 | A * | 1/1979 | Archibald | 415/199.3 |
| 4,850,818 | A * | 7/1989 | Kotera | 417/366 |
| 2002/0038727 | A1 | 4/2002 | Moore et al. | |
| 2002/0066572 | A1 | 6/2002 | Muth | |

OTHER PUBLICATIONS

International Search Report issued Jul. 10, 2009 in PCT/1B08/03534 filed Dec. 18, 2008 (in English).

* cited by examiner

*Primary Examiner* — Igor Kershteyn
(74) *Attorney, Agent, or Firm* — Oblon, Spivak, McClelland, Maier & Neustadt, L.L.P.

(57) ABSTRACT

The present invention provides a water lubricated line shaft bearing assembly, comprising an outer annular steel shell and an inner layer made of low friction material attached to the outer shell, the inner layer having a non-uniform thickness which is formed with wall portions of increased thickness defining a plurality of shaft engaging portions and with wall portions of reduced thickness defining a plurality of lubricant passages. The shaft engaging portions are capable of being journalled on a line shaft adapted to drive a downhole geothermal production pump and the steel shell is engageable with an inner wall of a lubrication tube vertically extending through a water column through which pumped geothermal fluid is delivered, lubrication water bled from the pumped geothermal fluid being used to supply lubrication water through the lubricant passages. The steel shell has sufficient compressive strength to withstand the stress imposed by the high rotational speed of the line shaft of the geothermal production pump. The low friction material of the inner liner allows solid debris present or entrained in the lubrication water to slide over the inner line. Solid debris is prevented from accumulating due to the presence of the passages through which the lubrication water flows.

11 Claims, 4 Drawing Sheets

FIG. 1

WATER LUBRICATED LINE SHAFT BEARING AND LUBRICATION SYSTEM FOR A GEOTHERMAL PUMP

FIELD OF THE INVENTION

The present invention relates to the field of geothermal liquid supply systems. More particularly, the invention relates to a water lubricated line shaft bearing and lubrication system for a geothermal production pump.

BACKGROUND OF THE INVENTION

Downhole geothermal production pumps are adapted to lift geothermal fluid from within a well or column to the ground surface. The geothermal fluid is pumped at a high temperature and pressure, e.g. a temperature in the order of 500° F. and a pressure in the order of 300 psi which is greater than its flash point, in order to ensure continual geothermal liquid flow throughout the geothermal system and thus also prevent scale precipitation.

Due to the high temperature and pressure of geothermal fluid, considerable pump bearing wear is noticeable. Petroleum oil is generally used as a lubricant, to prevent excessive wear to a bearing mounted on the main pump shaft. However, the drive shaft and bearings of geothermal production pumps are prone for failure as a result of the intrusion of the high-pressure geothermal fluid into the line through which the lubricant is delivered. Bearing failure is also caused by the precipitation of scale thereon.

U.S. Pat. No. 4,276,002 discloses a submerged turbopump unit for pumping hot geothermal liquids from deep wells to the earth's surface. The wear of the bearings associated with the turbopump is minimized by supplying lubricating liquid, e.g. hot water, thereto which is taken from an intermediate stage of a centrifugal pump at the surface which supplies motive liquid to the turbine.

However, no prior art water-lubricated bearings are known to the applicant for the long drive shaft (hereinafter referred to as a "line shaft") extending from a surface mounted motor to the pump submersed in the water column. U.S. Pat. No. 4,276,002 describes an improved turbopump unit for pumping hot geothermal liquids from deep wells. However, there are many technical challenges of applying geothermal water to line shafts even when taking the teachings of U.S. Pat. No. 4,276,002 into consideration. These challenges include mechanically sealing the shaft at the surface, maintaining pressure above saturation in a low pressure system and, in addition, dealing with the corrosiveness of geothermal fluid to line shaft bearings. For example, it is recited in U.S. Pat. No. 4,276,002 that bled geothermal water needs to be cooled and filtered.

It is an object of the present invention to provide a geothermal production pump bearing which is unaffected by the intrusion of geothermal fluid into the lubrication line.

It is an additional object of the present invention to provide a reliable water lubricated line shaft bearing.

It is an additional object of the present invention to provide a water lubricated geothermal line shaft bearing which is unaffected by the precipitation of scale thereon during the flow of lubrication water.

It is yet an additional object of the present invention to provide a water lubricated geothermal line shaft bearing which has sufficient strength to withstand high compressive loads imposed by the rotating line shaft.

It is yet a further object of the present invention to provide a lubrication system that ensures sufficient lubrication of the line shaft bearing.

Other objects and advantages of the invention will become apparent as the description proceeds.

SUMMARY OF THE INVENTION

The present invention provides a water lubricated line shaft bearing assembly, comprising an outer annular steel shell and an inner layer made of low friction material attached to said outer shell, said inner layer having a non-uniform thickness which is formed with wall portions of increased thickness defining a plurality of shaft engaging portions and with wall portions of reduced thickness defining a plurality of lubricant passages.

The shaft engaging portions are capable of being journalled on a line shaft adapted to drive a downhole geothermal production pump and the steel shell is engageable with an inner wall of a lubrication tube vertically extending through a water column through which pumped geothermal fluid is delivered, lubrication water bled from the pumped geothermal fluid being used to supply lubrication water through the lubricant passages.

The steel shell has sufficient compressive strength to withstand the stress imposed by the high rotational speed of the line shaft of the geothermal production pump. The low friction material of the inner liner allows solid debris present or entrained in the lubrication water to slide over the inner line. Solid debris is prevented from accumulating due to the presence of the passages through which the lubrication water flows.

In one aspect, the shaft engaging portions are arcs having a common center which trace a complete circle, and preferably have an equal circumferential length.

In another aspect, each lubricant passage is a slot formed within the inner layer being defined by a first wall extending from one end of a first shaft engaging portion to an adjacent wall portion of reduced thickness, a second wall extending from one end of a second shaft engaging portion to the adjacent wall portion of reduced thickness, and a third arc shaped wall extending from the first wall to the second wall, the third wall coinciding with the adjacent wall portion of reduced thickness.

In a further aspect, the first and second walls are preferably mutually parallel planar walls.

In an additonal aspect, pairs of passages are diametrically opposite to each other and are arranged such that a first planar wall portion of a passage is collinear with the second planar wall portion of a diametrically opposite passage.

The low friction material is selected from the group of Teflon and glass blended with Teflon.

Lubrication water is preferably bled from the pumped geothermal fluid by means of a lubrication system operable to ensure that the inner layer of the bearings is continuously moist.

BRIEF DESCRIPTION OF THE DRAWINGS

Embodiments of the invention are described below by way of example and with reference to the accompanying drawings wherein.

DETAILED DESCRIPTION OF PREFERRED EMBODIMENTS

Figure 1:
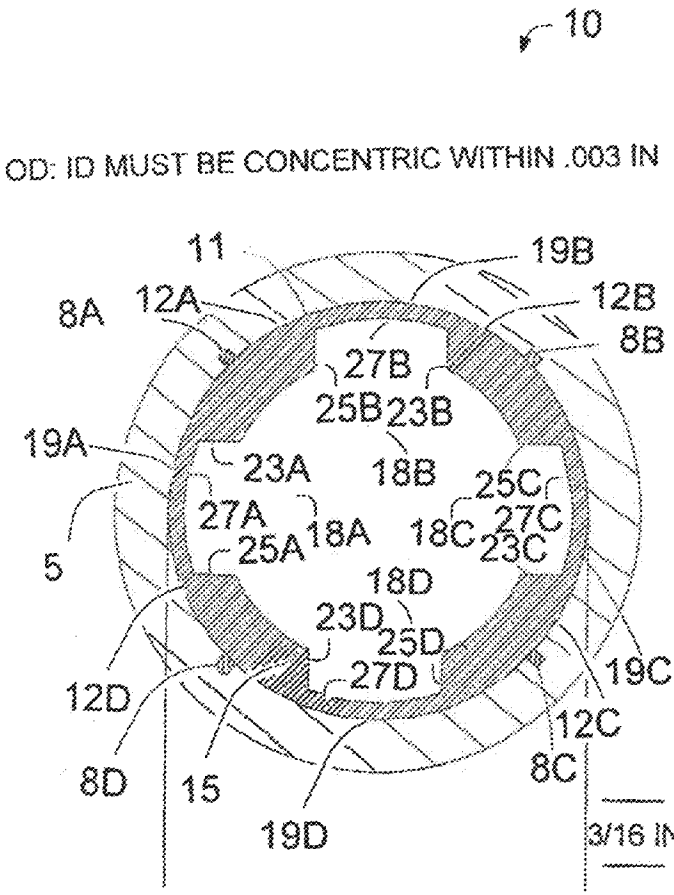
FIG. 1 is a cross sectional view of a line shaft water-lubricated bearing assembly, according to one embodiment of the invention.

FIG. 1 illustrates a cross sectional view of a line shaft water-lubricated bearing assembly of a downhole geothermal production pump, according to one embodiment of the present invention. The line shaft bearing assembly designated by numeral 10 has a novel partial arc configuration by which the bearing can be journalled to the line shaft, yet permits the passage of solid debris entrained in the lubrication water that is bled from the pumped geothermal fluid.

As shown in FIG. 1, bearing assembly 10 comprises an outer annular steel shell 5, e.g. made of carbon steel, e.g. standard boiler steel and an inner layer 15 made of low friction material, e.g. Teflon®, glass blended with Teflon® to provide thermal stability. Preferably, less than about 10% glass is used in the glass blended with Teflon® option. Inner layer 15 is attached to shell 5 by means of pins 8A-D radially extending from outer surface 11 of inner layer 15, which are received in complementary recessed portions formed in the inner surface of shell 5, so that the radial clearance between shell and inner liner 15 is e.g. about 0.025 in. Inner layer 15 has a non-uniform thickness which defines shaft engaging portions 16A-D and lubricant passages 18A-D. That is, inner layer 15 is formed from two types of wall portions: wall portions 12A-D of increased thickness from outer periphery 11 of inner layer 15 to shaft engaging portions 16A-D, respectively, and wall portions 19A-D of reduced thickness from outer periphery 11 of inner layer 15 to lubricant passages 18A-D, respectively.

Shaft engaging portions 16A-D are arcs of preferably an equal circumferential length having a common center and which trace a complete circle, to allow the line shaft to be received thereby. Lubricant passages 18A-D are slots formed within inner layer 15, and are preferably arranged, as shown in the illustrated arrangement, such that two passages are diametrically opposite to each other and that two adjacent passages are equally angularly spaced. Each of the four passages 18A-D has a corresponding first planar wall portion 23A-D extending from the circumferential end of one adjacent shaft engaging portion, a second planar wall portion 25A-D extending from the circumferential end of the other adjacent shaft engaging portion, and an arc shaped recessed wall portion 27A-D extending from the first to second wall portion. Preferably, the first planar wall portion is collinear with the second planar wall portion of the diametrically opposite passage. With respect to an illustrative, exemplary bearing assembly, the outer diameter of the steel shell is 2.875 in., the inner diameter of the steel shell is 2.500 in., the distance between diametrically opposite recessed wall portions is 2.300 in., the distance between diametrically opposite shaft engaging portions is 1.9625 in., and the distance between first and second wall portions is 1.00 in.

It will be appreciated that inner layer 15 may be configured differently, such as with any other number and circumferential length of shaft engaging portions.

Figure 2:
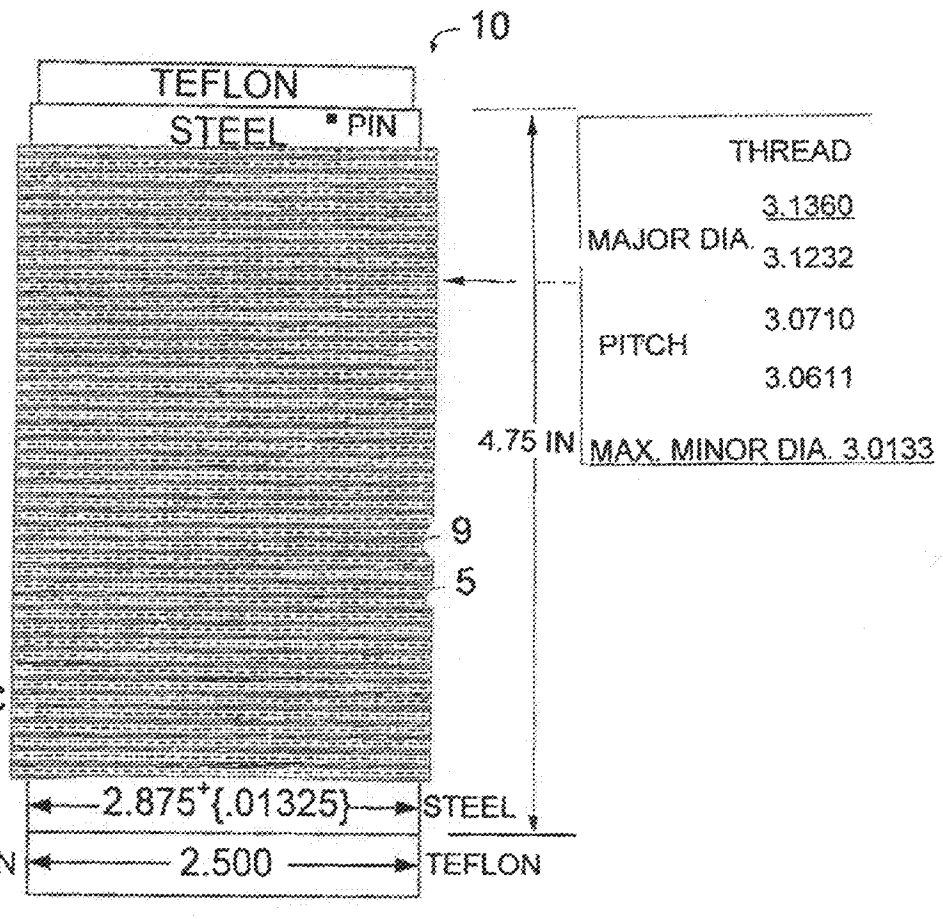
FIG. 2 is a front view of the bearing assembly of FIG. 1.

FIG. 2 illustrates a front view of bearing assembly 10. The outer surface of shell 5 is formed with threads 9 which are engageable with threads formed within the inner wall of a lubrication tube.

Figure 3:
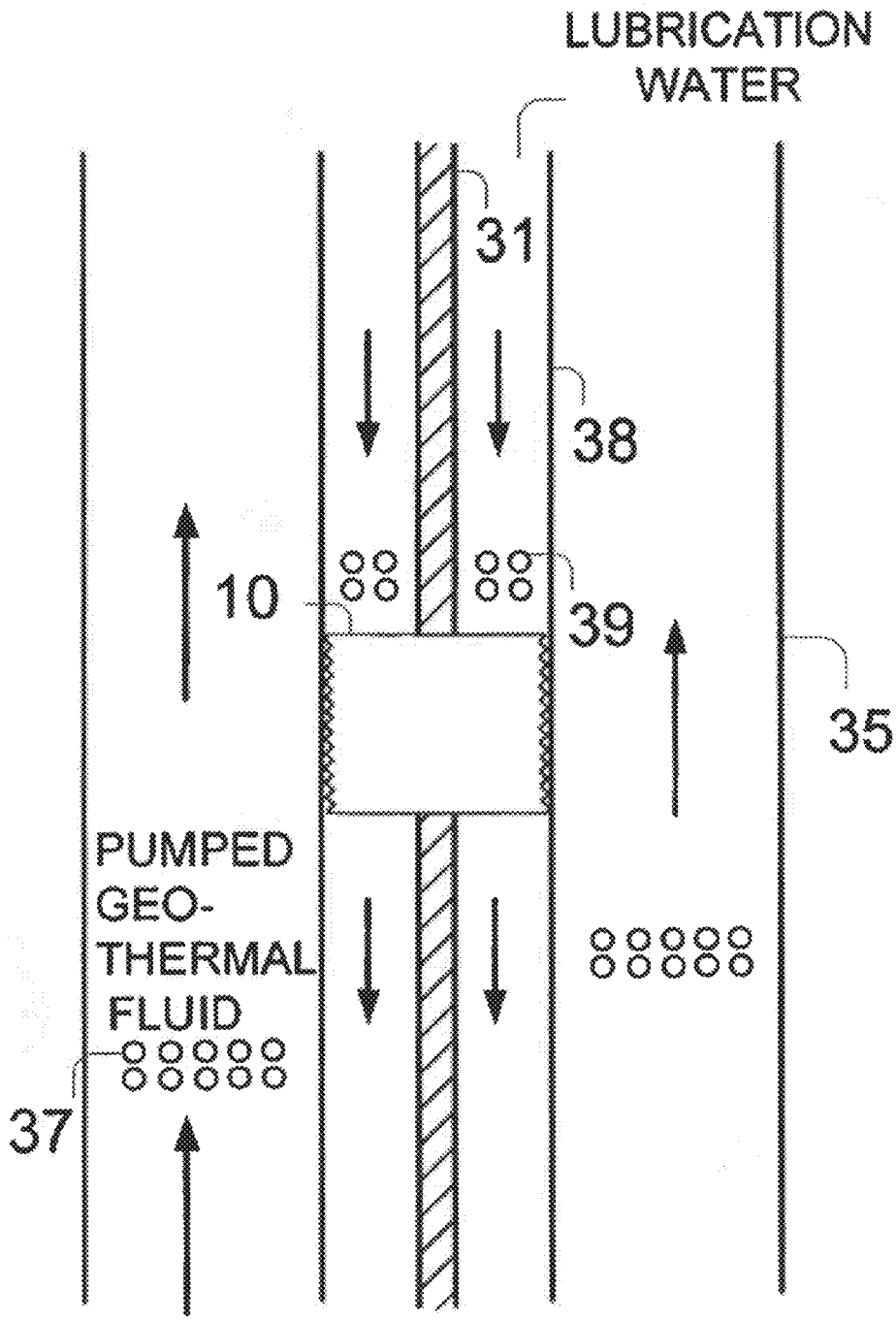
FIG. 3 is a schematic vertical cross section of a portion of a water column and of a lubrication tube extending vertically within the water column of a geothermal production well, illustrating a water-lubricated bearing mounted on a line shaft and engaged with the lubrication tube.

FIG. 3 illustrates a schematic vertical cross section of a portion of water column 35 of a geothermal production well. Also shown is a portion of a line shaft 31 driven by a surface mounted motor for transmitting torque to pump 55 (FIG. 4), e.g. a multi-stage impeller pump or turbine pump, submersed in water column 35, through which geothermal fluid having a temperature ranging from about 275° F. (135° C.) to 400° F. (205° C.) is delivered at a flow rate ranging from about e.g. 1000 to 3500 gpm. These flow conditions prevent the flashing and the resultant precipitation of scale within the pumped geothermal fluid. Line shaft 31 extends downwardly from the surface mounted motor substantially through the center of lubrication tube 38. Bearing assembly 10, which is shown in front view, is journalled on line shaft 31 and is engaged with the inner wall of lubrication tube 38 by use of threads 9 present on the outer surface of shell 5 of bearing assembly 10 (see FIG. 2). Bearing assembly 10 has a height of about e.g. 4 in. and is journalled on line shaft 31 at a distance ranging from about 4 in. to 6 in., e.g. 5 feet, from an adjacent bearing. Lubrication tube 38 in turn extends substantially through the center of water column 35. During operation of the geothermal production pump, geothermal fluid 37 is raised to ground level so that it can be used for power production or for any other suitable industrial process, through the annulus of column 35 and lubrication tube 38. Lubrication water 39 is supplied from the pump discharge and is delivered to the bearings along the length of lubrication tube 38.

Figure 4:
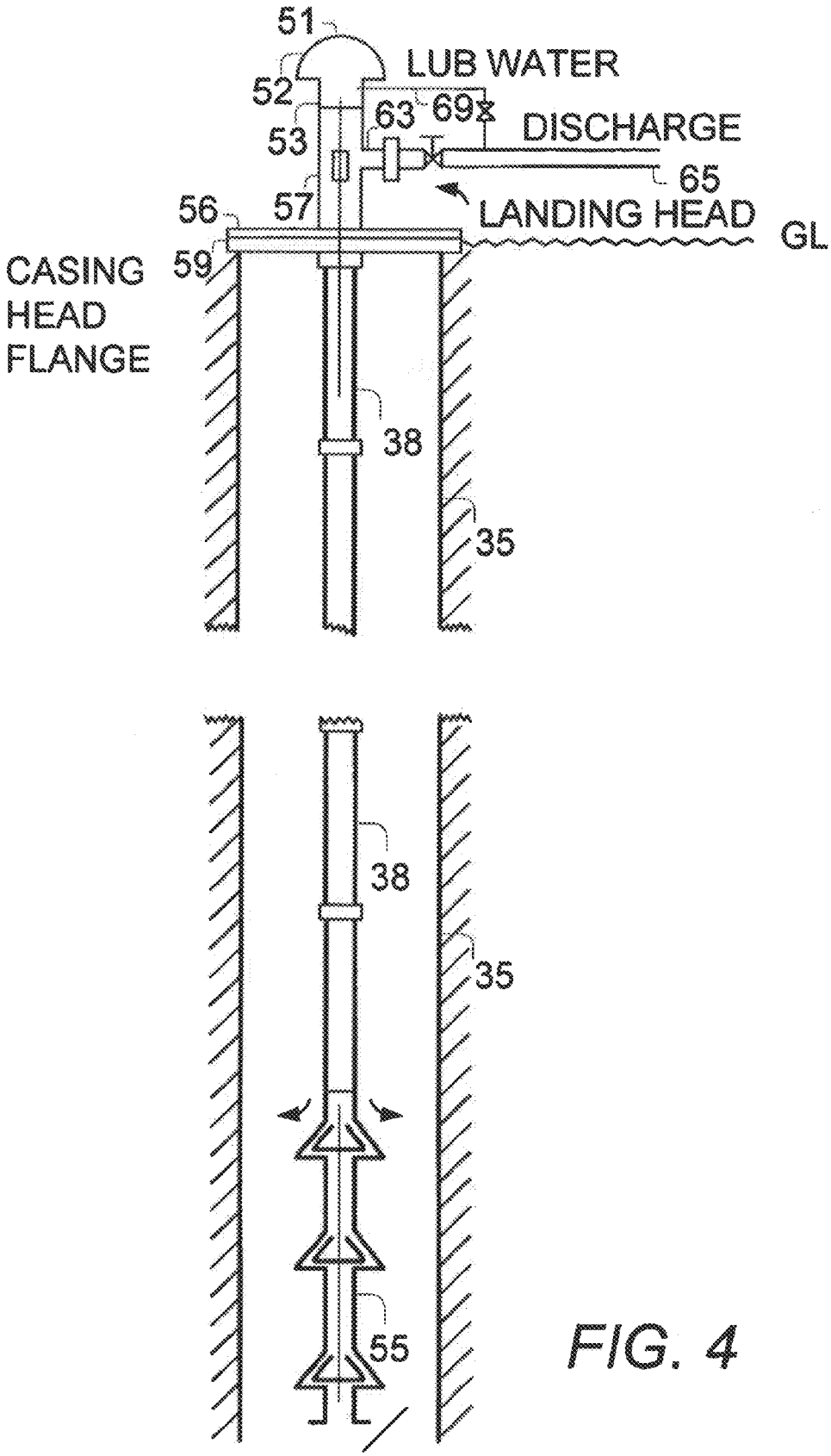
FIG. 4 is a schematic vertical cross section of upper and lower portions of water column of a geothermal production well, illustrating a submerged pump and a line through which lubrication water is bled from discharged geothermal fluid.

FIG. 4 illustrates a schematic vertical cross section of upper and lower portions of water column 35 of a geothermal production well. Surface mounted motor 51 of pump 55 enclosed by casing 52 is supported by casing head flange 56, which is positioned in overlying relation to, and bolted to a flange 59 of, water column 35. Water column flange 59 is generally located above ground level GL. Lubrication tube 38, through which line shaft 31 (FIG. 3) transmits torque generated by motor 51 to pump 55, extends from throat 53 of casing 52 to the upper end of pump 55. Annular landing head 57, which is attached to both throat 53 and casing head flange 56, is in communication with the pumped geothermal fluid. The geothermal fluid delivered upwardly by pump 55 flows through the annulus of water column 35 and of landing head 57, and then exits via discharge pipe 65 connected to fitting 63 of landing head 57. A portion of the discharged geothermal fluid is bled from pipe 65 via line 69 to the inlet of lubrication tube 38 which is located within throat 53 of motor casing 52.

Figure 5:
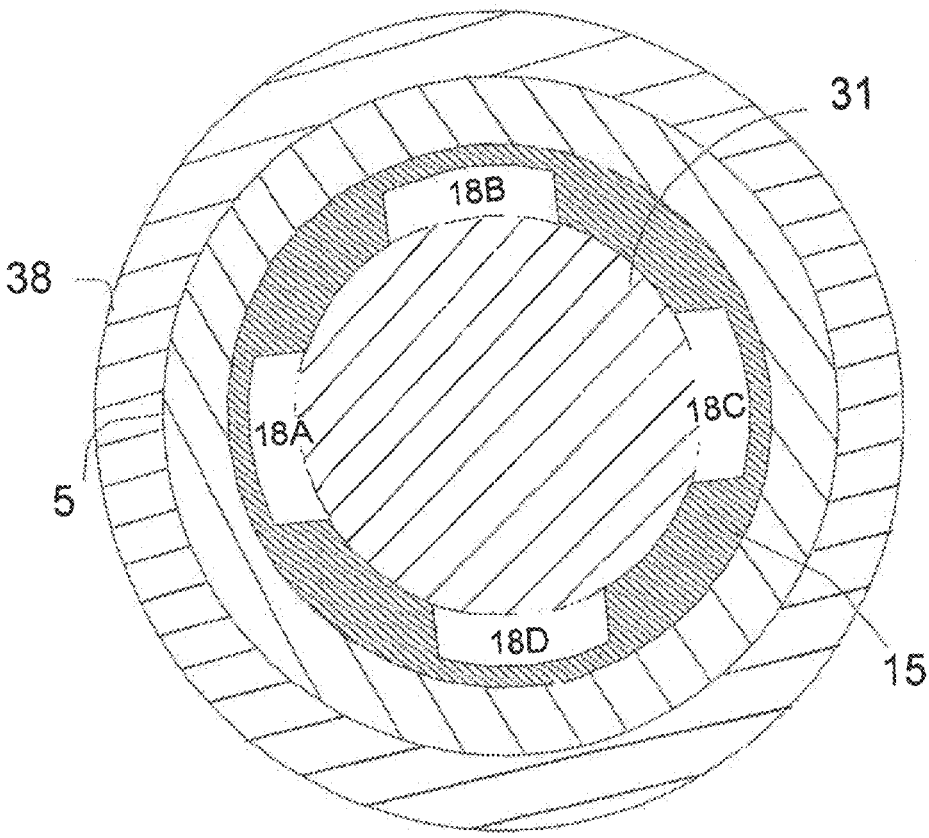
FIG. 5 is a cross sectional view of the bearing of FIG. 1 which is journalled on a line shaft.

FIG. 5 illustrates a cross section of lubrication tube 38 when line shaft 31 is received by shaft engaging portions 16A-D (FIG. 1) of bearing assembly inner layer 15. As shown, the interior of lubrication tube 38 is occupied by shell 5 engaged to the inner face of lubrication tube 38 by use of threads 9 present on the outer surface of shell 5 of bearing assembly 10 (see FIG. 2 ) and inner layer 15 of the bearing assembly, and by line shaft 31. Reduced wear of inner liner 15 with respect to metallic bearings is noticeable due to the high lubricity of the low friction material from which inner liner 15 is made. The material from which steel shell 5 is made has sufficient compressive strength to withstand the stress imposed on the low friction material of inner layer 15 by the rotation of line shaft 31 at a rate ranging from about 1750 to 2500 rpm and by the thermal expansion of inner layer 15.

Cavities defined by passages 18A-D remain between inner layer wall portions of reduced thickness and the outer periphery of line shaft 31, and the lubrication water bled from discharge pipe 65 via line 69 (FIG. 4) flows through passages 18A-D. The lubrication water serves to cool inner layer 15. Lubrication water flows across shaft engaging portions 16A-D which are in contact with line shaft 31. The low friction material advantageously allows solid debris present or entrained in the lubrication water to slide over inner layer 15. The presence of passages 18A-D permits the flow of debris across the passages and prevents its accumulation.

Due to the configuration of line 69 and of the associated flow control devices, which will be described hereinafter, the flow rate of lubrication water within passages 18A-D can be e.g. about 10 gpm, while the lubrication water has a temperature ranging from about 60° F. (15.5° C.) to 400° F. (205° C.) and a pressure ranging from about 40 to 200 psi. These flow conditions provide lubrication and prevent the flashing and the resultant precipitation of scale within the lubrication water.

Even though the low friction material of inner liner 15 advantageously permits solid debris present or entrained in the lubrication water to slide over the inner layer during the flow of lubrication water, it is susceptible to damage if allowed to run dry. To prevent damage to inner liner 15 during a pump startup or unanticipated pump malfunction when the inner liner may be dry, the lubrication system is advantageously provided with control valves which cause the lubrication water to change direction in order to keep inner liner 15 moist. Tolerances on pump throttle bushing have been increased to allow more "leakage" of fluid into the line shaft allowing lubricating fluid flow. No such modification is required in the top down design.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A water lubricated line shaft bearing assembly for a geothermal production pump, comprising:

an outer annular steel shell and an inner layer made of low friction material attached to said outer shell, said inner layer having a non-uniform thickness which is formed with wall portions of increased thickness defining a plurality of shaft engaging portions and with wall portions of reduced thickness defining a plurality of lubricant passages, wherein said shaft engaging portions are capable of being journalled on a line shaft adapted to drive a downhole geothermal production pump and said steel shell is engageable with a wall of a lubrication tube vertically extending through a water column through which pumped geothermal fluid is delivered, lubrication water bled from said pumped geothermal fluid flowing through said lubricant passages, and wherein each lubricant passage is a slot formed within the inner layer being defined by a first wall extending from one end of a first shaft engaging portion to an adjacent wall portion of reduced thickness, a second wall extending from one end of a second shaft engaging portion to said adjacent wall portion of reduced thickness, and a third wall having an arc shape extending from said first wall to said second wall, said third wall coinciding with said adjacent wall portion of reduced thickness.

2. The bearing assembly according to claim 1, wherein the shaft engaging portions are arcs having a common center which trace a complete circle.

3. The bearing assembly according to claim 2, wherein each arc has an equal circumferential length.

4. The bearing assembly according to claim 1, wherein the first and second walls are mutually parallel planar walls.

5. The bearing assembly according to claim 4, wherein pairs of passages are diametrically opposite to each other and are arranged such that a first planar wall portion of a passage is collinear with the second planar wall portion of a diametrically opposite passage.

6. The bearing assembly according to claim 1, wherein the low friction material is selected from the group of Teflon and glass blended with Teflon.

7. The bearing assembly according to claim 1, wherein lubrication water is bled from the pumped geothermal fluid by means of a lubrication system operable to ensure that the inner layer is continuously moist.

8. A water lubricated line shaft bearing assembly for a geothermal production pump in a water column, and that pumps water through the water column, comprising:

a lubrication tube extending through the water column and leading to the geothermal production pump, wherein the geothermal production pump is functional to pump water through an annulus defined by the lubrication tube in the water column;

a line shaft in said lubrication tube and functional to drive said geothermal production pump;

a bearing assembly element provided within the lubrication tube between a wall of said lubrication tube and said line shaft for providing bearing support of said line shaft in said lubrication tube, the bearing assembly element comprising an outer annular steel shell engaged with the wall of the lubrication tube, and an inner layer made of low friction material attached to said outer shell, said inner layer having a non-uniform thickness which is formed with wall portions of increased thickness defining a plurality of shaft engaging portions journalled on a line shaft, and with wall portions of reduced thickness defining a plurality of lubricant passages; and means for routing a portion of the water pumped through the water column to the plurality of lubricant passages.

9. The bearing assembly according to claim 8, wherein the means for routing a portion of the water pumped through the water column to the plurality of lubricant passages comprises a line bleeding a portion of the water pumped through the water column to an inlet of the lubrication tube.

10. The bearing assembly according to claim 8, wherein each lubricant passage is a slot formed within the inner layer being defined by a first wall extending from one end of a first shaft engaging portion to an adjacent wall portion of reduced thickness, a second wall extending from one end of a second shaft engaging portion to said adjacent wall portion of reduced thickness, and a third wall having an arc shape extending from said from said first wall to said second wall, said third wall coinciding with said adjacent wall portion of reduced thickness.

11. The bearing assembly according to claim 10, wherein the first and second walls are mutually parallel planar walls.

* * * * *